US008673048B2

(12) United States Patent
Song et al.

(10) Patent No.: US 8,673,048 B2
(45) Date of Patent: Mar. 18, 2014

(54) MAGNETIC SEPARATION OF IRON FROM ALUMINUM OR MAGNESIUM ALLOY MELTS

(75) Inventors: Guangling Song, Troy, MI (US); Jan F. Herbst, Grosse Pointe Woods, MI (US); Anil K. Sachdev, Rochester Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 55 days.

(21) Appl. No.: 13/316,611

(22) Filed: Dec. 12, 2011

(65) Prior Publication Data

US 2013/0145899 A1 Jun. 13, 2013

(51) Int. Cl.

| | |
|---|---|
| ***C22B 21/00*** | (2006.01) |
| ***B22D 27/02*** | (2006.01) |
| ***B03C 1/02*** | (2006.01) |

(52) U.S. Cl.

USPC ..... 75/10.67; 75/401; 210/695; 204/557; 148/108

(58) Field of Classification Search

USPC ..... 75/10.67, 401; 210/695; 204/557

See application file for complete search history.

(56) References Cited

U.S. PATENT DOCUMENTS

| | | | | |
|---|---|---|---|---|
| 4,436,627 | A | 3/1984 | McMonigle | |
| 4,539,040 | A | 9/1985 | Mawardi | |
| 5,803,947 | A | 9/1998 | Engell et al. | |
| 6,355,085 | B1 | 3/2002 | Pillin et al. | |
| 2009/0285716 | A1 | 11/2009 | Verdier et al. | |
| 2010/0101957 | A1* | 4/2010 | Araseki | 204/557 |
| 2010/0228056 | A1 | 9/2010 | Wang et al. | |

FOREIGN PATENT DOCUMENTS

| | | |
|---|---|---|
| CN | 1354267 A | 6/2002 |
| CN | 101285131 B | 6/2010 |

OTHER PUBLICATIONS

Machine translation of CN 1354267 published Jun. 19, 2002.*

Zhenming Xu et al., Electromagnetic Filtration of Primary Fe-Rich Phases from Al-Si Alloy Melt; J. Mater. Sci. Technol., vol. 17, No. 3, 2001; pp. 306-310.

* cited by examiner

*Primary Examiner* — George Wyszomierski
*Assistant Examiner* — Tima M McGuthry Banks
(74) *Attorney, Agent, or Firm* — Reising Ethington P.C.

(57) ABSTRACT

Iron impurities may be removed from volumes of molten aluminum or magnesium metals or alloys by applying a static magnetic field gradient to each of the molten metal volumes, or melts. The magnetic field gradient is applied to each of the melts so that separate-phase iron impurities suspended therein will move in the direction of the applied magnetic field and become concentrated in a predetermined region of the of the melts, thereby forming an iron-rich region. The remaining iron-depleted region of each of the melts can be physically separated from the as-formed iron-rich region and cast into shaped articles of manufacture or into semi-finished articles for further processing. Such articles will have a lower iron-content than the original molten metal volumes.

16 Claims, 2 Drawing Sheets

MAGNETIC SEPARATION OF IRON FROM ALUMINUM OR MAGNESIUM ALLOY MELTS

TECHNICAL FIELD

This invention pertains to methods of refining nonferrous metals or alloys, such as aluminum or magnesium alloys. More specifically, this invention pertains to methods of applying a magnetic field gradient to a volume of a molten nonferrous metal to and remove separate-phase iron impurities from the molten metal.

BACKGROUND OF THE INVENTION

Alloys, consisting of a base metal and one or more other metals or non-metals, are prepared in order to alter the mechanical or chemical properties of the base metal. For example, alloying may be performed to induce hardness, toughness, ductility, corrosion resistance, or other desired properties into the base metal. In practice, alloys are formulated and used to produce cast or wrought metal parts having certain desirable properties which correspond to their end uses. Aluminum (Al) and magnesium (Mg) alloys are commonly used to make cast or wrought automotive parts, such as sand cast engine blocks, because these nonferrous alloys are relatively light weight and corrosion resistant (compared to cast iron or steel).

The presence of impurities, however, in these alloy compositions can significantly impact the mechanical and chemical properties of the alloy parts. For example, elemental iron is considered an impurity in aluminum alloy parts used in the automotive industry because, in high concentrations, iron reduces the ductility and tensile strength of the alloy part. In magnesium alloys, iron is also considered an impurity because it renders the alloy part more susceptible to corrosion. High-purity metals, such as aluminum and magnesium, however, are not readily available. Therefore, these metals and their alloying elements may need to be refined or purified before downstream casting or forming processes.

One method of removing iron impurities from aluminum or magnesium alloys is by heating the alloys to form melts, and then precipitating iron-rich inter-metallic particles, also known as "sludge," from the melts. In this method, iron-rich inter-metallic phases are formed within the melts by adding certain metal elements, such as manganese, chromium or zinc, to the melts. The melts are then cooled to initiate nucleation and crystallization of iron-containing inter-metallic particles from the iron-rich phases. The iron-containing particles precipitate from the melts and are then removed, for example by gravity separation or filtration.

However, the amount of manganese, chromium, or zinc added to each melt is critical to the formation of sludge, but is difficult to control. Additionally, methods of separating precipitated particles from melts of aluminum or magnesium are inefficient and any metals added during the precipitation process that remain in the melts can adversely affect the mechanical and chemical properties of the cast alloy parts. There is therefore a need for a more efficient method of effectively removing iron from aluminum or magnesium alloys.

SUMMARY OF THE INVENTION

This invention provides an efficient and effective method for removing iron impurities from volumes of molten nonferrous metals or alloys, for example from volumes of molten aluminum or magnesium alloys. A static magnetic field is generated within a predetermined region of a molten iron-containing nonferrous metal volume or melt. The static magnetic field is a gradient field and is applied to the melt so as to cause movement of iron-containing masses within the melt toward a predetermined location. The static magnetic field gradient is applied to the melt for an amount of time to form an iron-rich region within the melt which can be physically separated from the remaining iron-depleted region of the melt.

This method of purification does not require alteration of the melt composition to form large iron-containing precipitates, which must be of sufficient density to precipitate from the melt or must be of sufficient diameter to be filtered from the melt. In addition, the rate at which the iron-containing masses are separated from the nonferrous metal melt can be controlled by controlling the strength and gradient of the applied magnetic field. Following physical separation from the iron-rich portion of the melt, the iron-depleted portion can then be cast into shaped articles of manufacture or into semi-finished articles for further processing. And such articles will have a much lower iron content than the original melt.

In one embodiment, an iron-containing nonferrous metal is prepared for refinement by heating the nonferrous metal or alloy in a suitable vessel to form a melt. The nonferrous metal or alloy is suitably heated to a temperature at which the nonferrous metal is substantially present as a liquid and iron impurities within the metal exist as distinct liquid or solid iron-containing phases. For example, the iron impurities may be in the form of iron particles or iron-containing particles suspended within the melt which do not naturally settle to the bottom of the melt or readily precipitate therefrom. Although the nonferrous metal is mostly in liquid form, solid particles that do not comprise iron may also be suspended within the melt.

Thereafter, a magnetic field gradient is applied to the melt and is used to confine the iron-containing phases in a predetermined region of the melt. In the presence of the applied magnetic field, the iron-containing phases in the melt will experience a force proportional to the gradient of the magnetic field in the direction of the applied field. At the same time, the iron-containing phases will experience a force resisting their movement through the melt known as viscous drag. Accordingly, if the gradient of the applied magnetic field is strong enough, the iron-containing phases will move through the melt from a region of lesser magnetic field gradient to a region of greater magnetic field gradient.

The magnetic field gradient is suitably generated in a predetermined region of the melt for an amount of time to confine the iron-containing phases to a predetermined region within the metal melt volume. Thereafter, the iron-enriched volume of the melt can be physically separated from the purified volume of the melt, such as by removing the iron-rich volume from the melt or vice versa. Either portion of the melt can be removed therefrom by a variety of methods as will undoubtedly be known in the art. For example, if the melt is held within a crucible furnace, a portion of the melt may be removed therefrom via ladling, pouring, tapping, or through the use of pumps or siphons. A physical barrier between the iron-rich region and the iron-depleted region may be placed within the melt during the removal process. In addition, the magnetic field may be maintained as necessary to retain the relatively small volume of the iron-containing phases in one region of the melt during the separation and removal processes.

The nonferrous metal may be heated in a vessel that is suitable for melting and/or casting nonferrous metals and alloys. The vessel may be of a material that does not significantly affect the magnitude or direction of the applied magnetic field. Or, the vessel may be formed of a material which may distort the magnetic field, such as, for example if the vessel is made of iron. In the first case, the magnetic field generator may lie close to, but outside of, the vessel and melt. In the second case, the magnetic field generator may be located within the vessel and possibly in direct contact with the melt so that the vessel will not interfere with the separation or removal processes.

The magnetic field gradient may be generated in the melt using any device that is capable of generating a suitably strong magnetic field, even at high temperatures, for example up to 900° C. Such known devices include permanent magnets and electromagnets. In addition, the magnetic field generator may be thermally insulated from the melt and/or cooled during the separation and removal processes so that the device continuously and effectively generates a magnetic field of sufficient gradient in the predetermined region of the nonferrous metal melt during the separation and removal processes.

The magnetic field may be applied to the entire volume of the melt or to a portion of the melt. If the magnetic field is only applied to a portion of the melt, thermal currents within the melt may provide sufficient mixing for the iron impurities within the melt to be exposed to the magnetic field gradient. The magnetic field may be applied to one region in the melt for the entire separation process, or the location of the magnetic field gradient may be varied, for example using an externally controlled magnetic generator. In addition, more than one magnetic field may be applied to the melt at a time to further control the movement of the iron impurities within the melt.

Nonferrous metals or alloys that have been refined according to embodiments of this invention may be cast into ingots or castings, or transferred to another vessel for further melting, holding, or casting processes. Casting of molten aluminum or magnesium alloys is typically accomplished by transferring the liquid molten metal or alloy to a mold where it is cooled and solidifies.

The term "nonferrous metal" is used in this specification to mean any light metal that does not contain appreciable amounts of iron. For example, in addition to aluminum and magnesium, copper (Cu), zinc (Zn), tin (Sn), silver (Ag), and gold (Au) are all nonferrous metals that may be purified according to embodiments disclosed herein.

These and other aspects of the invention are described below, while still others will be readily apparent to those skilled in the art based on the descriptions provided in this specification.

DESCRIPTION OF PREFERRED EMBODIMENTS

Melts comprising nonferrous metals or alloys are often prepared for the purpose of casting shaped articles of manufacture or for casting semi-finished articles, such as ingots, billets, blooms, and slabs. Such melts may be prepared by placing the nonferrous metal or alloy in a suitably heated vessel. In practice, a solid or liquid charge comprising the nonferrous metal and any alloying elements is typically placed in a melting hearth or crucible of a fuel-fired or electric furnace. Common furnaces used to melt and cast nonferrous metals and alloys include coreless and channel induction furnaces, crucible and open-hearth reverberatory furnaces, and electric resistance and electric radiation furnaces. The type of furnace used will depend on the availability and cost of fuel, the desired melting rate, and on the desired volume of the melt. Suitable furnaces for melting nonferrous metals or alloys according to embodiments of this invention will have capacities in the range of about 50-2000 lbs.

Figure 1:
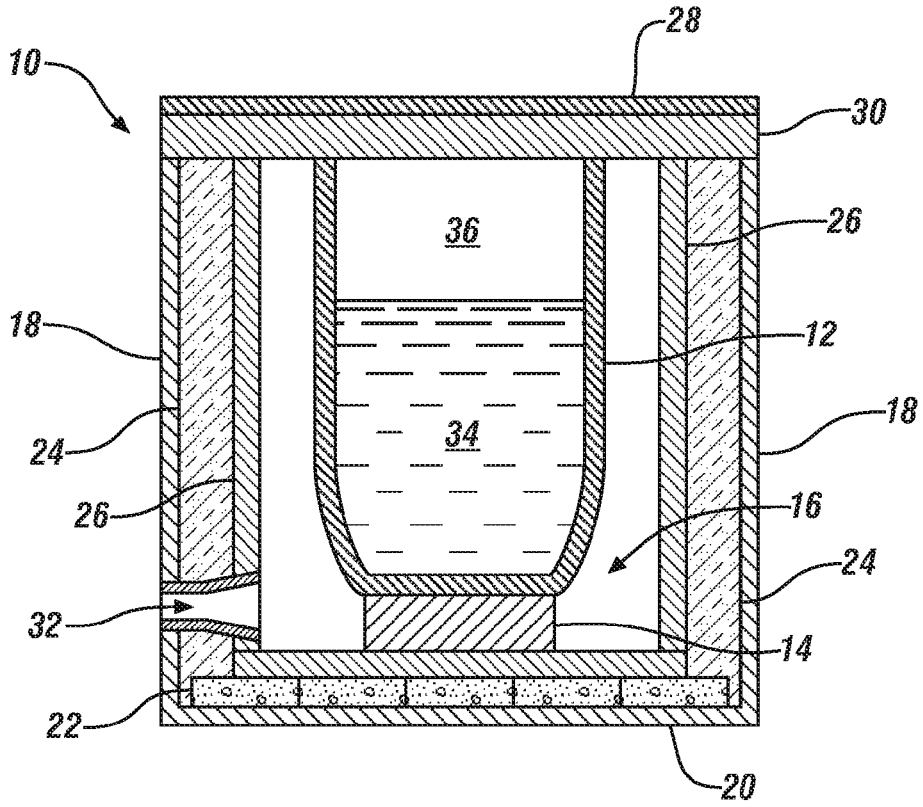
FIG. 1 is a schematic representation of a cross-section of an iron-containing nonferrous metal melt that is held within a crucible or pot furnace.

By way of illustration, a suitable crucible or pot furnace 10 for melting nonferrous metals and alloys is shown in FIG. 1. This type of furnace 10 is designed to receive a vessel known as a crucible 12 which rests upon a pedestal block or base 14 within a combustion chamber 16. The furnace 10 includes a metal casing with outer walls 18 and a bottom 20. The bottom 20 of the metal casing is suitably lined with firebrick or other refractory material 22 and the outer walls 18 are suitably lined with an insulating material 24. In addition, another layer of refractory material 26 is typically used to line the combustion chamber 16 of the furnace 10. The furnace 10 may have a lid or cover that is configured to slide on or be elevated from the side walls of the furnace. The lid or cover may include an outer layer of metal 28 and an inner layer of refractory material 30.

The crucible 12 is heated by a burner (not shown) which is fueled such as by oil or gas and is placed in a burner inlet hole 32 located in the bottom side wall of the furnace 10. Burners are typically located so that a flame from the burner is tangential to the crucible 12. The combustion chamber 16 will also include a vent (not shown) that is adapted to carry the combustion products away from the furnace 10. In practice, a charge is placed within the crucible 12 where it is heated to form a melt of molten metal 34. The charge may be in the form of returned gates and risers, returns from machining operations, pre-alloyed ingots, molten metal or the like.

The crucible 12 may be a bale-out crucible that is stationary, and a ladle may be used to remove small amounts of the molten metal 34 for casting operations. Alternatively, the crucible 12 may be a lift-out crucible and may have a pouring spout so that the entire crucible 12 may be lifted from the furnace 10, for example with tongs, and used as a pouring ladle. If the furnace is a tilting crucible furnace, the entire furnace 10 can be tilted to permit pouring of the melt 34 directly into a transfer ladle (not shown). Other suitable means of forcing the molten metal 34 from the crucible 12 to a casting operation will be well known to those skilled in the art.

Suitable crucibles 12 for melting and holding aluminum melts may be made of refractory material or of refractory-coated cast iron. Refractory crucibles have thick walls to provide strength and are preferred over iron crucibles to prevent iron contamination of aluminum melts. Most refractory crucibles for melting aluminum are made of carbon-bonded silicon carbide, but may be lined with high-alumina brick bonded with phosphoric acid if a cast iron crucible is used. Magnesium alloy melts are typically heated in a crucible of stainless steel. Suitable stainless steels used for handling magnesium melts include 400 series stainless steels. Magnesium melts may be heated in a crucible that is lined with an inert coating, such as boron nitride. Fire brick and refractory materials are not typically used to line crucibles for magnesium melts. Tools used in melting, holding and casting molten aluminum or magnesium are preferably made of steel, cast iron, or stainless steels that are coated with an inert coating, such as boron nitride.

During the melting process, the aluminum or magnesium melt may interact with gases in the atmosphere above the melt 36, such as hydrogen, oxygen, nitrogen, water, carbon monoxide, carbon dioxide and hydrocarbons, to form unwanted compounds within the melt 34. To prevent these unwanted interactions, a protective gas or a protective flux may be used to cover the melt or may be added to the melt as it is heated (not shown). Common degassing fluxes used in foundry melting of aluminum include chlorine and fluorine containing salts; common cover fluxes comprise a mixture of NaCl and KCl and may also contain some additions of $CaCl_2$, $CaF_2$ or KF. In foundry melting of magnesium, sulfur dioxide is commonly used as a flux or gas.

A nonferrous metal or alloy melt 34 that contains an unwanted amount of iron is prepared for refinement by heating the melt to a temperature at which the nonferrous metal or alloy is primarily present as a liquid and the iron is present as a distinct liquid or solid iron-containing phase, such as a particle 38. The temperature at which such a heterogeneous mixture will form depends on the composition of the nonferrous metal or alloy and upon the solidification rate. For example, elemental aluminum and magnesium have melting points of 660° C. and 650° C., respectively. However, alloys of aluminum and magnesium typically have lower melting points and may contain more than one distinct phase at a given temperature. In practices of this invention, aluminum or magnesium alloys melts may be heated to temperatures in the range of about 550-850° C., more preferably in the range of about 600-750° C.

Figure 3:
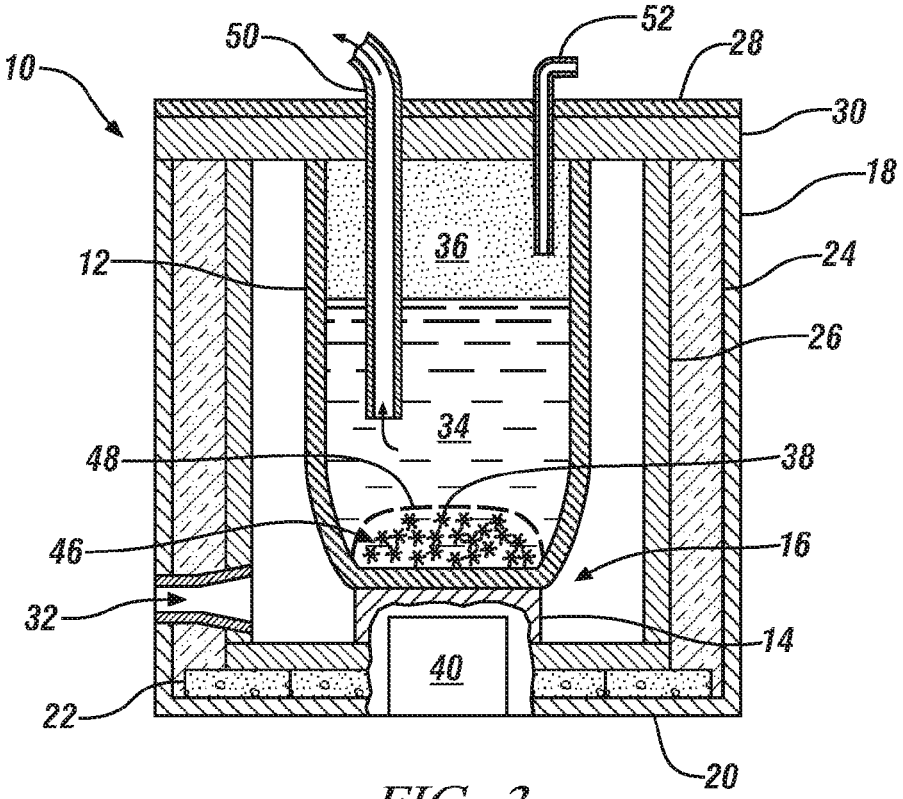
FIG. 3 is a schematic representation of a cross-section of the crucible or pot furnace shown in FIG. 2 after the magnetic field gradient has been applied to the iron-containing nonferrous metal melt for an amount of time to form a concentration of iron impurities at the bottom of the crucible near the magnetic field generator. As shown, an insulated pipe is immersed within the melt and an air pipe is located above the surface of the melt so that the atmosphere above the melt can be pressurized and the iron-depleted nonferrous metal can be siphoned from the crucible leaving the iron impurities at the bottom of the crucible.
Figure 4:
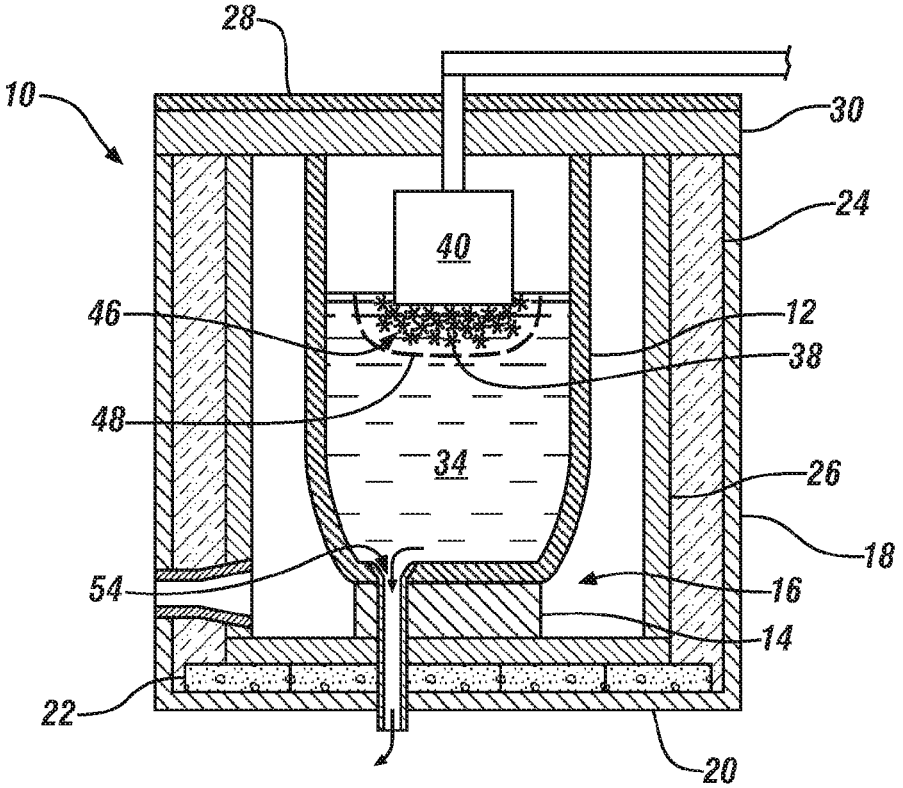
FIG. 4 is a schematic representation of a cross-section of the crucible or pot furnace shown in FIG. 1 with a magnetic field generator positioned at the surface of the melt. A magnetic field gradient has been applied to the iron-containing nonferrous metal melt for an amount of time to form a concentration of iron impurities at the top of the melt near the magnetic field generator. As shown, a tap hole is located at the bottom of the crucible so that the iron-depleted region of the melt can flow out of the crucible leaving the concentration of iron impurities behind.

Once the iron is present within the melt 34 as a distinct liquid or solid iron-containing phase 38, a magnetic field generator 40 is used to apply a magnetic field gradient to at least a portion of the melt 34. In one embodiment, the magnetic field may be applied to the melt 34 by placing the magnetic field generator 40 near the base of the crucible 12, as shown in FIGS. 2 and 3, near the surface of the melt 34, or within the melt 34 itself, as shown in FIG. 4.

Figure 2:
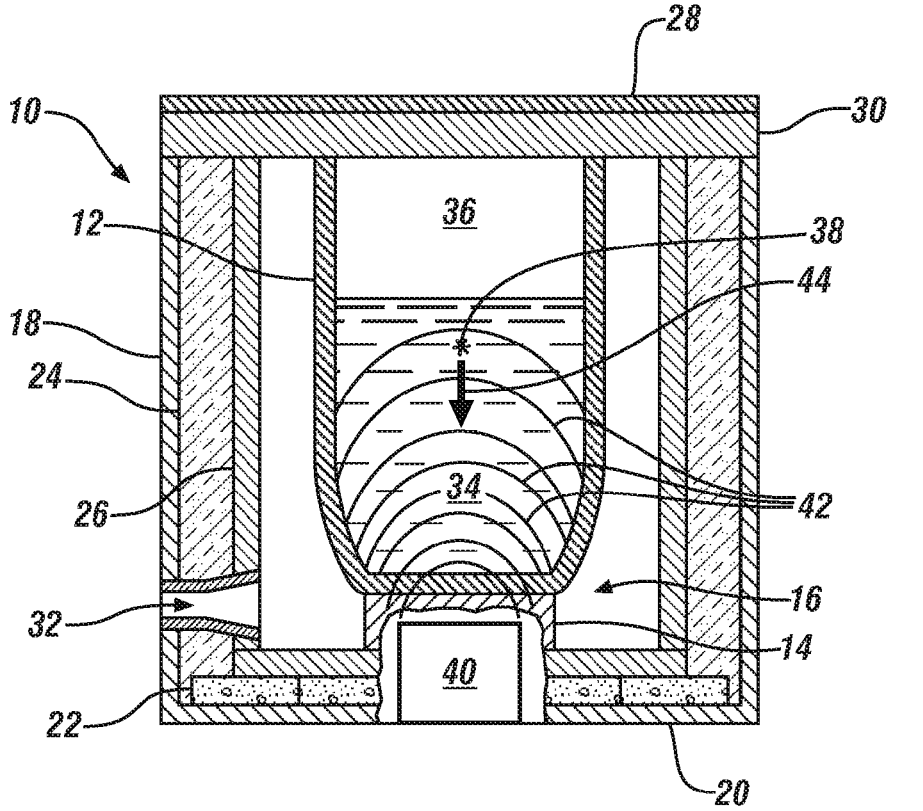
FIG. 2 is a schematic representation of a cross-section of the crucible or pot furnace shown in FIG. 1 with a magnetic field generator positioned at the base of the crucible. A magnetic field line diagram has been drawn outwardly from the magnetic field generator to symbolically illustrate the gradient within the iron-containing nonferrous metal melt. In reality, however, the magnetic field gradient will extend outwardly in all directions from the magnetic field generator, not just within the melt. The magnetic field lines increase in density near the magnetic field generator to symbolically illustrate how the strength of the magnetic gradient increases within the melt. It is important to note, however, that the magnetic field lines have been drawn without accounting for any distortion that may occur to the magnetic field as it passes through the material of the pedestal or crucible.

FIG. 2 depicts a magnetic field line diagram that has been drawn outwardly from the magnetic field generator 40 to symbolically illustrate the magnetic gradient generated within the iron-containing nonferrous metal melt 34. In reality, however, the magnetic field will extend outwardly in all directions from the magnetic field generator 40, not just within the melt 34. Magnetic field lines 42 are shown with increasing density near the magnetic field generator 40 to symbolically illustrate how the strength of the magnetic gradient increases within the melt 34. As the density of the field lines 42 increases, so does the strength of the magnetic gradient. It is important to note, however, that the magnetic field lines 42 are drawn without accounting for any distortion that may occur to the magnetic field as it passes through the material of the crucible 12.

In the presence of the applied magnetic field, the separate iron-containing phases 38 will experience a net magnetic force proportional to the gradient of the magnetic field in the direction of the applied field as shown by the arrow 44 in FIG. 2. The nonferrous metal or alloy phases of the melt 34 will also experience a net magnetic force in the direction of the applied field. However, the force experienced by the iron-containing phases 38 will be much larger than the force exerted on the nonferrous phases due to differences in the magnetic behavior of these phases.

At the same time the iron-containing phases 38 experience the magnetic force they will also experience an opposing force due to the viscosity of the melt. Therefore, in order for the iron-containing phases to experience a net force in the direction of the applied field, the magnetic force must be greater than the force of viscous drag. In addition, the magnetic field must be applied to the melt 34 for an amount of time to concentrate at least a portion of the iron-containing phases 38 in one region of the melt 34. The amount of time required for the iron-containing phases 38 to concentrate in one region of the melt will depend upon certain properties of the melt and the magnitude of the magnetic field gradient. For example, as the temperature of the melt increases to the Curie temperature of iron (770° C.), the magnetic force on the iron-containing phases will decrease. But, at higher temperatures, the viscosity of the melt will decrease, which will also decrease the drag force experienced by the iron-containing phases.

The magnetic field is applied to the melt 34 so that the iron-containing phases 38 will move through the melt 34 from a region of lower field gradient to a region of higher field gradient. After the magnetic field has been applied to the melt 34 for a sufficient amount of time, a concentration of iron-containing phases 38, or an "iron-rich" region 46, will form within the melt near the magnetic field generator 40, as shown in FIGS. 3 and 4. The remaining portion of the melt 34 will thus comprise a nonferrous metal or alloy that has been depleted of iron, or "refined." This region may be referred to herein as an "iron-depleted" region.

This method of magnetic separation can be used to effectively and efficiently separate iron or iron-containing phases from a melt of a nonferrous material. In addition, this method does not require alteration of the melt composition to form large iron-containing precipitates which must be of sufficient density to precipitate from the melt or must be of a sufficient diameter to be filtered from the melt. Further, this method allows for the separation of solid iron-containing particles as well as liquid iron-containing phases from a nonferrous melt.

The refined nonferrous metal or alloy can then be separated from the iron-containing phases 38 by removing the iron-rich portion 46 or the iron-depleted portion of the melt 34 from the crucible 12. In order to prevent mixing of the melt during the removal process, the iron-rich region 46 may be physically confined to one region of the melt 34, for example by a physical barrier 48. In suitable embodiments, the physical barrier 48 may be integrated into the design of the crucible 12 and may be constructed so as to allow movement of the iron-containing phases throughout the melt during the magnetic separation process. The physical barrier 48 may also be configured to close after a concentration of iron-containing phases 38, or an iron-rich region 46, has formed within the confines of the barrier.

Equipment for removing either portion of the melt 34 will be well known to persons having ordinary skill in the art. For example, the furnace may be designed so that the molten metal 34 can be removed by ladling, either manual or mechanized, or the furnace may be constructed to permit tilting for pouring into ladles. The furnace may have a tap hole that can be opened to allow the molten metal to flow into ladles or any other suitable container. Siphons or pumps may also be used to remove a portion of the molten metal from the crucible. Suitably, all pipes, troughs and ladles will be well insulated with refractory material to minimize heat losses during the removal and transportation processes.

In one embodiment, as shown in FIG. 3, the refined nonferrous metal or alloy is siphoned from an upper portion of the melt 34 while the concentration of iron-containing phases 38 is confined in a lower portion of the melt 34, for example, by the physical barrier 48. In this embodiment, an insulated tube 50 is inserted into the melt 34 to a predetermined depth. The tube 50 extends from the melt 34 and furnace 10 and provides a path for the molten metal to be transported away from the furnace 10. The atmosphere above the melt 36 is pressurized by pumping gas through a pipe 52 into the furnace 10. The pressurized atmosphere above the melt 36 induces the molten metal 34 to flow from crucible 12.

In yet another embodiment, as shown in FIG. 4, the magnetic field generator 40 is placed within the melt 34 and the concentration of iron-containing phases 38 is held close to the generator 40, for example by the physical barrier 48. The magnetic field generator 40, the iron-containing phases 38, and the physical barrier 48 may be jointly removed from the melt 34 before or after a tap hole 54 located in the bottom of the crucible 12 and furnace 10 is opened so that the refined nonferrous metal or alloy may pass through the tap opening.

The refined nonferrous metal or alloy may be removed from the furnace and cast into ingots or castings, or it may be transferred to another heated vessel for further melting, holding, or casting processes. Casting of molten aluminum or magnesium alloys is accomplished by transferring the liquid molten metal alloy to a mold where it is cooled and solidifies. Examples of common casting methods used in the automotive industry include die casting, sand casting, structural casting, structural die casting, structural permanent mold casting and permanent mold casting. Additional casting methods may be used, and will undoubtedly be known in the art.

The magnetic field generator 40 may comprise a permanent magnet, electromagnet or other suitable device that is capable of generating a magnetic field even at high temperatures, such as that of molten metal. A suitable permanent magnet, for example, may be made of Alnico. Alnico magnets can produce magnetic fields at temperatures below their Curie point, which can be as high as 900° C. (Alnico 5). Electromagnets are suitable so long as they can generate a strong magnetic field at high temperatures. In addition, the magnetic field generator 36 can be insulated or cooled during the magnetic refining process so that the remains operable through the entire separation process.

Force on a Magnetic Material in a Magnetic Field Gradient

As discussed above in this specification, in the presence of a magnetic field gradient, iron-containing phases in a nonferrous melt will experience a force in the direction of the applied magnetic field. The iron-containing phases will experience this magnetic force because of the inherent magnetic behavior of iron. The nonferrous phases within the melt will also experience a force in the direction of the applied magnetic field. However, the force exerted on the iron-containing phases will be several orders or magnitude greater than the force exerted on the nonferrous phases.

Materials are classified as diamagnetic, paramagnetic or ferromagnetic depending on their magnetic behavior in an external magnetic field, B. Iron, cobalt and nickel are classified as ferromagnetic at temperatures below their Curie temperatures. Most nonferrous metals, such as aluminum and magnesium, are classified as paramagnetic, as are Fe, Co and Ni at temperatures above their Curie temperatures.

Magnetic fields generated by currents are generally characterized as magnetic fields B, which are measured in Tesla. But, when the generated fields pass through magnetic materials which themselves contribute internal magnetic fields, ambiguities can arise about what part of the field comes from the external currents and what comes from the material itself. Therefore, another magnetic field, H, is used and its value indicates the driving magnetic influence from external currents in a material, independent of the material's magnetic response. The magnetic field H is measured in amperes per meter (A/m).

Each atom of a paramagnetic material has a permanent magnetic moment. If the moments in a paramagnetic material are randomly oriented, the material has no net magnetic moment. However, when a paramagnetic material is placed in an external magnetic field, the atomic magnetic moments will partially align and the material will develop a net magnetic moment, m, in the same direction as the external magnetic field. The magnetic moment, m, is a vector and has both a direction and magnitude. If the field is a gradient field (also referred to as a non-uniform or inhomogeneous field), the paramagnetic material will be attracted toward a region of greater magnetic field from a region of lesser field. The net magnetic moment of a paramagnetic material will increase with an increase in the magnitude of the external magnetic field.

Each atom of a ferromagnetic material also has a permanent magnetic moment. But, unlike paramagnetic materials, some of the magnetic moments of the atoms in a ferromagnetic material are aligned due to a quantum effect known as exchange coupling, even in the absence of an external magnetic field. Such alignment produces regions within the material (domains) with strong magnetic moments. An external magnetic field can further align the magnetic moments of each domain within a ferromagnetic material, thereby increasing the net magnetic moment of the material. Magnetic saturation, $M_S$, occurs when practically all the domains are lined up, so further increases in applied magnetic field do not further align the domains. If the external field is non-uniform, the ferromagnetic material will experience a force (proportional to the magnetic field gradient), and will be attracted toward a region of greater magnetic field from a region of lesser field.

The force acting on a paramagnetic or ferromagnetic material due to a magnetic field H (a vector having both a magnitude and direction) can be approximated using the Gilbert model:

$$F=(m\cdot\nabla)H \tag{1}$$

If m and H are both in the same direction, for example z, then the magnetic force on the particle will be:

$$F=m(\partial H_z/\partial z) \tag{2}$$

Therefore, to determine the force, we must first calculate the net magnetic moment, m, of the paramagnetic or ferromagnetic material in the magnetic field H.

The Gilbert model is used to calculate the force on a magnetic material due to a non-uniform magnetic field, unlike the equation for Lorenz force, which calculates the force on a charged particle moving in a direction perpendicular to the magnetic field. As shown by the above equation, a magnetic material, such as iron, will experience a net force due to an applied magnetic field gradient even if the magnetic material does not carry a net positive or negative electric charge and is not moving.

When a material is placed in a magnetic field some of the magnetic moments of the material will become aligned in the direction of the applied field and the material will become magnetized. This magnetization (M) of a material is a vector and can be calculated using the following formula:

$$M=\frac{m}{V}, \tag{3}$$

where m is the total vector sum of all of the magnetic moments in a given volume V (in $m^3$) of the material. For paramagnetic materials, M is proportional to H. If the applied magnetic field is increased, the magnetization of the material will also increase. This is because a stronger magnetic field will align a greater quantity of magnetic moments.

The magnetization of a diamagnetic or paramagnetic material due to an applied magnetic field can be calculated using the following formula:

$$M=\chi H, \tag{4}$$

where $\chi$ is a dimensionless proportionality constant known as the magnetic susceptibility of a material, and indicates the degree of magnetization of a material in response to an applied magnetic field.

The magnetic susceptibility of a paramagnetic material is inversely proportional to temperature and is linear. The magnetic susceptibility of a paramagnetic material can be estimated using the following formula:

$$\chi=C/T, \tag{5}$$

where C is the Curie constant and is independent of temperature and different for each material. Thus, the magnetization of a paramagnetic material will decrease linearly with an increase in temperature. The magnetic field produced by the aligned magnetic moments of paramagnetic materials strengthens the external field. In general, the magnetic susceptibility of a paramagnetic material is relatively small and positive. For example, the magnetic susceptibilities of Al and Mg are $2.2\times10^{-5}$ and $1.2\times10^{-5}$, respectively, at 20° C.

The magnetic susceptibility, M, of a ferromagnetic material is not always proportional to H, and depends upon whether the material is above or below its Curie temperature, $T_C$. Above a ferromagnetic material's Curie temperature, it ceases to be spontaneously magnetized. Instead, the material behaves like a paramagnetic material and exhibits paramagnetic magnetic susceptibility. The Curie temperature for iron is about 770° C. The paramagnetic susceptibility of a ferromagnetic material is, in general, relatively large and positive. For example, the magnetic susceptibility of iron at 900° C. (above iron's $T_C$) is $1.8\times10^{-3}$.

For ferromagnetic materials below their Curie temperature, the relationship between M and H depends on the material's state of magnetization as well as its temperature. The magnetization of bulk iron at various temperatures, however, can be approximated if we know the saturation magnetization $M_S$ of iron over a range of temperatures. For example, at 20° C. (below the $T_C$ of iron) iron has a magnetization of $M=1.7\times10^6$ A/m.

By comparison, Mg metal has a magnetization of $M=\chi H=(1.2\times10^{-5})\times1000$ A/m$=1.2\times10^{-2}$ A/m at 20° C. in a reasonably large field of H=1000 A/m. And, even above the Curie temperature of iron, the magnetic susceptibility of iron will still be much larger than that of a paramagnetic material. Therefore, an iron-containing material in a given applied field H will experience a much larger induced magnetic moment than a paramagnetic material in the same field. Thus, the force, $F=m(\partial H_z/\partial z)$, acting on a ferromagnetic material due to a non-uniform external magnetic field will always be much larger than the force acting on a paramagnetic material in the same field.

Force (or Drag) on an Object Moving Through a Liquid

At the same time the iron-containing phases experience a force in the direction of the applied magnetic field, they will also experience a force opposing their movement through the liquid melt. The magnitude of this opposing hydrodynamic force depends upon the velocity with which the iron-containing phases moves through the melt and upon the viscosity of the melt. Therefore, in order to actually move the iron atoms or particles through the melt, the force due to the applied magnetic field must be greater than the opposing hydrodynamic force.

Assuming that the iron-containing phases are particles and move through the melt at relatively slow speeds without turbulence, the force of drag can be calculated using Stoke's Law:

$$F_d=-6\pi\eta rv, \tag{6}$$

where $\eta$ is the fluid viscosity, r is the Stoke's radius of the particle and v is the velocity of the particle. The dynamic viscosity $\eta$ of Al at its melting point of 660° C. (933 K) is known to be $1.3\times10^{-3}$ Pa-s. The dynamic viscosity $\eta$ of Mg at its melting point of 924 K is known to be $1.25\times10^{-3}$ Pa·s.

Net Force on a Ferromagnetic Material in an Magnetic Field Gradient

The net effect of the magnetic field gradient on a ferromagnetic particle can be estimated by assuming that the magnetic force and the viscous drag are the only forces present, so that the equation of motion is:

$$F=ma=m\frac{\partial v}{\partial t}=m\frac{\partial H_z}{\partial z}-6\pi\eta rv, \tag{7}$$

where m is the mass of the magnetic particle; a, v, and r are the particle's acceleration, velocity, and radius, respectively; and $\eta$ is the dynamic viscosity of the melt.

Taking v and the position z of the impurity to both be zero at time t=0, this equation can be solved to yield:

$$v(t) = v_0(1 - e^{-\alpha t}) \quad (8)$$

$$z(t) = v_0 t - \left(\frac{v_0}{\alpha}\right)(1 - e^{-\alpha t}) \quad (9)$$

$$v_0 \equiv m\frac{\partial H_z}{\partial z} \Big/ 6\pi\eta r \quad (10)$$

$$\alpha \equiv \frac{6\pi\eta r}{m} \quad (11)$$

where $v_0$ is the terminal velocity of the particle in this model, which is reached in a time of order $1/\alpha$.

The above equations can be used to determine the amount of time needed to effectively separate iron or iron-containing phases from a melt of a nonferrous metal if the strength of the magnetic field gradient is known. In addition, if the strength of the magnetic field gradient is known, these equations can be used to determine the size of the iron-containing particles that must be formed within the melt to afford separation.

The invention claimed is:

1. A method of separating iron from iron-containing aluminum or magnesium alloy melts, the method comprising:

forming a melt comprising molten aluminum or magnesium and iron in which the iron is present as distinct liquid or solid iron-containing phases suspended within the melt and including substantially no iron-containing precipitates of sufficient density to precipitate from the melt or of sufficient diameter to be filtered from the melt;

applying a static magnetic field gradient to the melt for an amount of time to separate the iron-containing phases from the molten aluminum or magnesium by forcing the iron-containing phases to move through the melt from a region of lesser static magnetic field gradient to a region of greater static magnetic field gradient so that an iron-rich region and an iron-depleted region form within the melt; and thereafter, physically separating the iron-rich region from the iron-depleted region.

2. The method of claim 1 wherein the magnetic field gradient is applied to the melt by placing at least one of a permanent magnet and an electromagnet near the melt.

3. The method of claim 1 wherein the distinct liquid or solid iron-containing phases comprise solid iron particles or iron-containing particles.

4. The method of claim 1 wherein the iron-rich region does not form within the melt due to gravitational forces acting on the iron-containing phases.

5. The method of claim 1 wherein the iron-containing phases do not possess a net electric charge.

6. The method of claim 1 further comprising:

applying an external magnetic field to the melt which gradually increases in strength from a first region to a second region so that the iron-containing phases move through the melt from the first region to the second region of the melt.

7. The method of claim 1 further comprising:

applying the magnetic field gradient to the melt and maintaining the magnetic field gradient within the melt while the iron-depleted region and the iron-rich region are physically separated.

8. The method of claim 1 further comprising:

inserting an insulated tube into the melt to a predetermined depth; and pressurizing the atmosphere above the melt so that the iron-depleted region or the iron-rich region is siphoned from the melt.

9. The method of claim 1 further comprising:

providing a pathway for removal of the iron-depleted region or the iron-rich region from the melt; and allowing the iron-depleted region or the iron-rich region of the melt to exit the melt through the pathway due to gravity.

10. The method of claim 1 wherein the magnetic field gradient is in the range of about 1 to 1000 Oe/cm.

11. The method of claim 1 wherein the melt has a temperature in the range of about 550-850° C.

12. A method of refining iron-containing nonferrous metals, the method comprising:

forming a melt in a suitably heated vessel, the melt comprising a nonferrous metal having solid iron-containing phases suspended therein and including substantially no iron-containing precipitates of sufficient density to precipitate from the melt or of sufficient diameter to be filtered from the melt;

applying a static magnetic field gradient to the melt to induce the solid iron-containing phases to move through the melt from a region of lesser static magnetic field gradient to a region of greater static magnetic field gradient so that an iron-rich region and an iron-depleted region form within the melt.

13. The method of claim 12 wherein the nonferrous metal comprises aluminum or magnesium.

14. The method of claim 12 wherein the magnetic field gradient is applied to the melt by positioning a magnetic field generator outside of the vessel or within the melt.

15. The method of claim 12 further comprising:

physically separating the iron-rich region from the iron-depleted region within the melt by forming a physical barrier around the iron-rich region to confine the iron-containing phases to a predetermined region in the vessel; and thereafter, removing the iron-rich region or the iron-depleted region from the vessel.

16. The method of claim 15 further comprising:

applying the magnetic field gradient to the melt and maintaining the magnetic field gradient within the melt while the iron-depleted region or the iron-rich region is removed from the vessel.

* * * * *